US005470399A

United States Patent [19]

Bae

[11] Patent Number: 5,470,399

[45] Date of Patent: Nov. 28, 1995

[54] PROCESS FOR MANUFACTURING MPP CORE FORMING POWDER, AND PROCESS FOR MANUFACTURING MPP CORE USING THE POWDER

[75] Inventor: Kwang W. Bae, Seoul, Rep. of Korea

[73] Assignee: Samsung Electro-Mechanics Co., Ltd., Kyongki, Rep. of Korea

[21] Appl. No.: 265,717

[22] Filed: Jun. 24, 1994

[30] Foreign Application Priority Data

Jun. 30, 1993 [KR] Rep. of Korea ..... 1993-12083

[51] Int. Cl.[6] ..... H01F 1/12

[52] U.S. Cl. ..... 148/104; 75/332; 75/338

[58] Field of Search ..... 148/104; 75/332, 75/338

[56] References Cited

U.S. PATENT DOCUMENTS

| | | | |
|---|---|---|---|
| 2,105,070 | 1/1938 | Bandur | 148/104 |
| 3,014,825 | 12/1961 | Harendza-Harinxman | 148/104 |
| 3,255,052 | 6/1966 | Opitz | 148/105 |
| 3,666,571 | 5/1972 | Laing | 148/104 |
| 3,777,295 | 12/1973 | Laing | 335/297 |
| 5,143,541 | 9/1992 | Sugitani | 75/338 |
| 5,352,268 | 10/1994 | Meguro et al. | 75/338 |

*Primary Examiner*—John Sheehan
*Attorney, Agent, or Firm*—Lowe, Price, LeBlanc & Becker

[57] ABSTRACT

A moly permalloy powder core (MPP core) to be used in SMPS (switching mode power supply) and DC converters is disclosed. Particularly, a process for manufacturing an MPP core forming powder and a process for manufacturing the MPP core using the MPP core forming powder are disclosed, in which the MPP core forming powder can be directly manufactured from melts. The process for manufacturing a powder for an MPP core (moly permalloy powder core) includes the steps of: melting an alloy composed of, in wt %, 1.6–4.0% of Mo, 78–83% of Ni, and the balance of Fe; and manufacturing a powder by spouting a fluid into the flow of the melts. As the Mpp core forming material is manufactured directly from the melts, the workability and productivity are improved, and the yield and the forming density can be also improved, as well as improving the frequency characteristics of the MPP core.

24 Claims, 5 Drawing Sheets

PROCESS FOR MANUFACTURING MPP CORE FORMING POWDER, AND PROCESS FOR MANUFACTURING MPP CORE USING THE POWDER

FIELD OF THE INVENTION

The present invention relates to a moly permalloy powder core (to be called MPP core below) which is used in SMPS (switching mode power supply) and DC converters. Particularly, the present invention relates to a process for manufacturing MPP core forming powder and a process for manufacturing the MPP core using the MPP core forming powder, in which the MPP core forming powder can be directly manufactured from melts.

BACKGROUND OF THE INVENTION

Generally, the MPP core is used on SMPS and DC converters, has a high permeability and shows a small frequency loss, so that the energy loss of the applied apparatus should be reduced, and that the bulk of the apparatus should also be reduced.

Generally, the MPP core is manufactured based on the process of FIG. 1, and this will be described below in detail. That is, in order to manufacture the MPP core, first an alloy consisting of Ni (nickel), Mo (molybdenum) and Fe (steel) is melted in a furnace such as an electric furnace or the like. Then, ingots of a certain size are formed.

The alloy for manufacturing the MPP core has the composition of 1.6–4.0 wt % of Mo, and 78–83 wt % of Ni, the balance being Fe. The melting of the alloy is carried out by heating it to a temperature of over 1500° C. for 1 hour or more.

Then the ingots which have been formed in the above described manner are heated to a temperature of over 500° C. to carry out hot rollings by 3 passes or more, thereby manufacturing strips having a width of about 60 inches. Then the strips are quenched by using a cooling medium such as water.

The quenching is carried out for facilitating the crushing which follows, and for forming a disordered state in the atomic arrangement within the material. Therefore, the quenching conditions are controlled in view of the above purposes. Then the strips which have undergone through the quenching are crushed to a certain particle size, and are made to pass through a mesh sieve, so that particles bigger than a certain size should be removed, thereby completing the manufacture of the MPP core forming powder.

The generally accepted average size of the MPP core forming powder is about 50 μm, and in sorting the powder of this size, the scale of the sieve is selected to be 120 meshes, so that particles of over 120 meshes should be removed. Then mica is mixed to the sorted powder, and then, the mixture is heated under a reducing atmosphere containing hydrogen to a temperature of 1170°–1400° F. Then the mixture is maintained at the same temperature for hour or more, and then, the mixture is cooled down to 300° C. within the furnace. Then the mixture is quenched down to the room temperature.

The above described annealing is for relieving the stress and strain remaining in the crushed powder, and therefore, the annealing conditions are controlled in this view.

The powder which is heat-treated in the above described manner is coated with a ceramic for insulating the particles, and then, the powder is formed into the desired shape.

Here, in order to reduce the frictions between the particles and particles and between the compacted body and the molding die, Zn-stearate is mixed by less than 1% prior to the molding.

Then the burrs which have been formed during the molding are removed, and then, the molded body is heated to a temperature of about 1170° F. under a reducing gas atmosphere containing hydrogen. It is maintained for over 0.6 hours, and then, is cooled within the furnace, thereby completing the annealing. Then the magnetic properties are checked, and then, in order to protect the core properties from the humidity and the external atmosphere, a polyester is coated on the surface of it, thereby completing the manufacturing of the MPP core.

The above described annealing is for relieving the stress and strain remaining in the molded body, and therefore, the annealing conditions are controlled in this view.

The conventional process for manufacturing the MPP core as described above involves too much complicated process steps, with the result that the work efficiency is lowered, that the manufacturing cost is increased, and that the productivity is lowered.

The conventional process obtains the MPP core forming powder by crushing, and therefore, the particles have irregular polyhedral shapes. Consequently, the molding density is low, with the result that the permeability of the MPP core is lowered.

Further, in the case of the conventional process, the powder particles have sharp corners, and therefore, the ceramic coating becomes non-uniform. In other words, the insulating coating of the powder particles becomes non-uniform, and therefore, problems occur to the frequency characteristics of the MPP core.

Further, superior techniques for manufacturing products of a smaller bulk and a lighter weight are in demand, and therefore, studies have been briskly made to meet the demand.

SUMMARY OF THE INVENTION

In accordance with the present trend in the relevant field, the present inventor has made studies for many years to manufacture the MPP core forming powder of superior properties with a simpler process, and has found a process in which the MPP core forming powder is directly produced from the melts.

Meanwhile, the method of producing the powder directly from the melts is the so-called atomizing method, and this method has not been applied to the function materials such as the MPP core, but was applied to only other fields such as materials for automobile components.

However, even in the applied fields, only pure metals were applied, but an alloy has not been applied.

The reason why alloys have not been applied is that, if an alloy is melted and a powder is produced from the melt, the powders particles do not have a uniform composition, but a part of the elements are segregated. This fact was confirmed by the present inventor. The degree of the segregation of the ingredients of the alloy, i.e., the non-uniformness of the composition of the powder particles, are varied depending on the kind of the composition of the alloy and on the oxidation characteristics.

Particularly, if the composition of the alloy becomes non-uniform, that is, if the ingredients are segregated, the permeability is markedly decreased, as well as causing an energy loss. Therefore, if the method of directly producing the MPP core powder from the alloy melts is to be applied to the function materials, it is required that the powder should have uniform compositions.

Therefore it is an object of the present invention to provide a process for manufacturing the MPP core forming powder, in which the MPP core forming powder is produced directly from the melts.

It is another object of the present invention to provide a process for manufacturing the MPP core forming powder, in which the particles have spherical or regular polyhedral shapes.

It is still another object of the present invention to provide a process for manufacturing the MPP core forming powder, in which the alloy composition of the particles is uniform, even if the powder is produced directly from the alloy melts.

It is still another object of the present invention to provide a process for manufacturing the MPP core forming powder, in which the process is simple, the permeability is high, and the frequency loss is small.

In achieving the above objects, the process for manufacturing the MPP core forming powder according to the present invention includes the steps of: melting an alloy composed of, in weight %, 1.6–4.0% of Mo, 78–83% of Ni, and the balance of Fe; and producing the intended powder by spouting a fluid into the flow of the melts.

The process for manufacturing the MPP core according to the present invention includes the steps of: melting an alloy composed of, in weight %, 1.6–4.0% of Mo, 78–83% of Ni, and the balance of Fe; producing the powder by spouting a fluid into the flow of the melts; coating the produced powder particles with a ceramic, and molding the core; and annealing the molded core, checking the magnetic properties of the core, and coating the core.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 1:
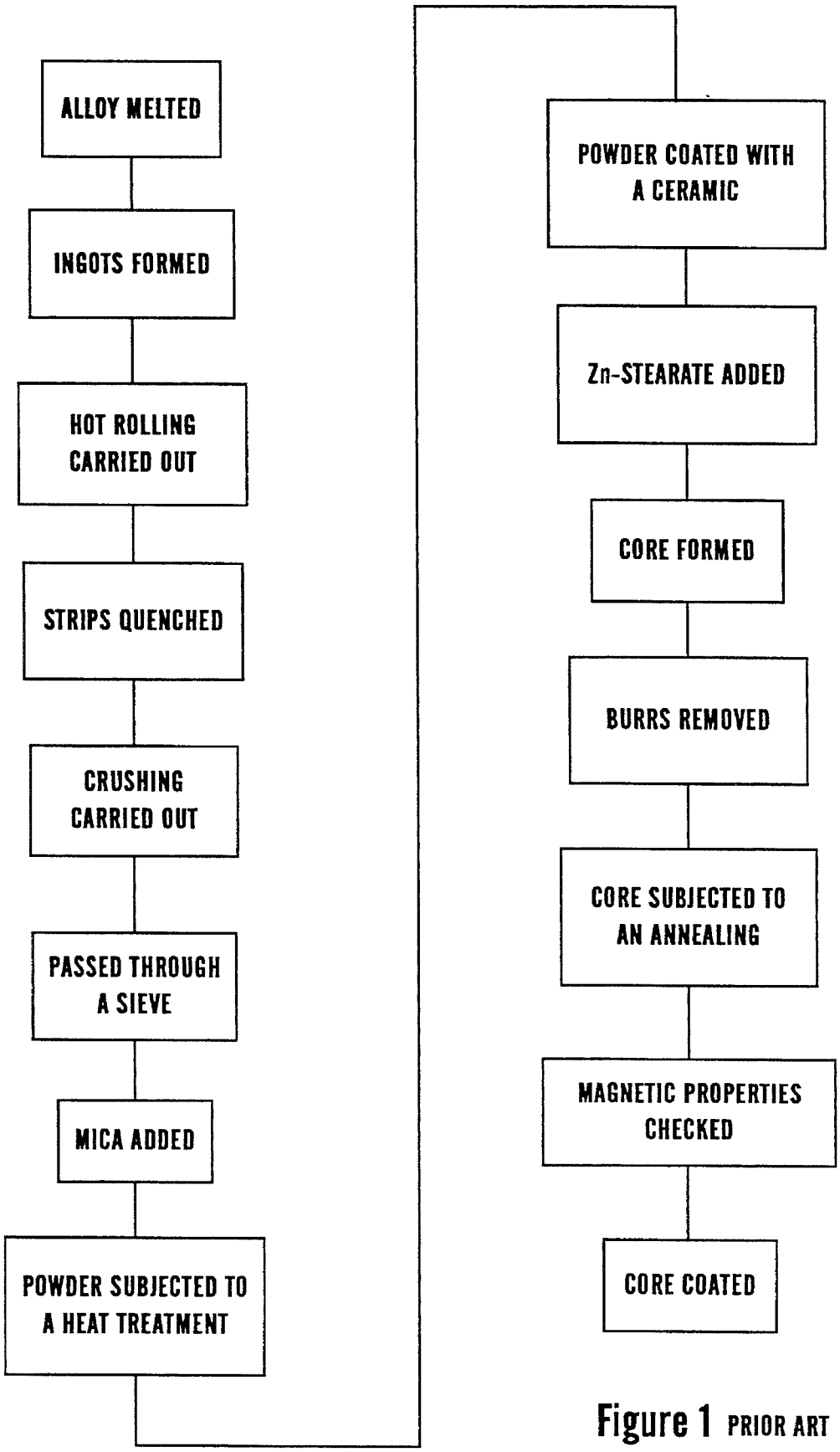
Figure 1 PRIOR ART
FIG. 1 is a block diagram showing the constitution of the conventional process for manufacturing the MPP core.

In preparing the melt of the present invention, Ni is first added and melted. Then Fe is added and melted, and then, an Fe—Mo alloy is added and melted. Or alternatively, an Fe—Mo alloy and Fe are added simultaneously and melted. Thus the final composition of the alloy for manufacturing the MPP core forming powder is prepared.

The addition ratio of the ingredients including Ni, Fe—Mo alloy, and Fe is controlled such that the composition includes: 1.6–4.0% of Mo, 78–83% of Ni, and the balance of Fe.

When Ni is melted, the heating temperature should be preferably 1600°–1650° C. The reason for such limitation range is that, if the temperature is lower than 1600° C., then Ni is not sufficiently melted, while if it is higher than 1650° C., the melt can be oxidized. The melting time period should be preferably more than one hour.

When an Fe—Mo alloy is added into the Ni melt, and is melted in it, the melting temperature should be preferably 1650°–1700° C. The reason is that, as in the above case, if the temperature is lower than 1650° C., the melting does not occur sufficiently, while if it is higher than 1700° C., the melt can be oxidized, as well as being uneconomical. The melting time period should be preferably more than one hour, if a sufficient melting is to be realized. As the Fe—Mo alloy, an ordinary one should be sufficient, but a more preferable alloy is the one having an addition ratio of Fe:40–70% and Mo:30–30%, and a most preferable alloy is the one having an addition ratio of Fe:40% and Mo: 60%.

When Fe is added into the Ni melt, the melting temperature should be preferably same as the case of using an Fe—Mo alloy.

After adding Fe—Mo alloy and Fe into the Ni melt and after melting them, in carrying out the alloying treatment, the temperature of the melts of Ni, Fe—Mo and Fe is raised to 1700°–1750° C. and this temperature range should be preferably maintained for one hour or more. The reason is that, if the temperature is below 1700° C., the diffusion of the atoms becomes slow so as to extend the alloying time and so as to lower the fluidity, with the result that the production of powder from the melt becomes difficult. If the temperature is higher than 1750° C., the melts may be vaporized, and the melts may be oxidized.

The alloying time should be preferably one hour or more for achieving a sufficient alloying. The metal Ni and the alloy Fe—Mo should have desirably a high purity, and preferably they should have a purity of over 99.9%.

The melt which has undergone the alloying treatment is formed into a powder through a spouting of a fluid. That is, a fluid is spouted to the flow of the melt, so that the spouted fluid drops should collide with the flow of the melt, thereby forming a powder. The fluid may consists of an inert gas such as argon, or $N_2$ gas or water. The fluid spouting conditions are decided by taking into account the intended powder particle size, the shape of the powder particles, and the atomic arrangement of the powder, while the conditions can also be varied in accordance with the kind of the fluid.

In the case where the fluid consists of an inert gas such as Ar, or $N_2$ gas, the particles have a spherical shape. In the case where the fluid consists of water, the particles have a regular polyhedral shape.

In the case where the fluid consists of an inert gas such as Ar or $N_2$ gas, the spouting pressure should be preferably 50–1200 psi, and the flow rate should be preferably 1–14 $m^3$/min. In the case where the fluid consists of water, the spouting pressure should be preferably 800–3000 psi, and the flow rate should be preferably 110–380 L/min.

If the spouting pressure is too low, the powder particle diameter is enlarged, and the shape of the particles becomes irregular. On the other hand, if the spouting pressure is too high, the particles have a spherical shape, but the particle diameter becomes too small. Therefore the proper spouting pressure is the above described range.

If the flow rate is too low, then the melt cannot be sufficiently quenched, and therefore, a disorder of the atomic arrangement cannot be obtained. On the other hand, if the flow rate is too high, the powder becomes non-uniform. Therefore, the flow rate should be the above described range.

In the case where $N_2$ gas is used, a liquified nitrogen of −183° C. should be preferably used, while in the case of water, the water may have a temperature of 25° C.

As described above, by varying the spouting conditions such as the spouting pressure and the spouting flow rate, diversified particle sizes, spherical or regular polyhedral shape, and disorders in the atomic arrangement can be obtained.

The desirable powder size distribution includes 10–15 wt % of −100–+230 meshes, 25–35 wt % of −230–+325 meshes, and 45–65 wt % of −325 meshes.

If the powder manufactured in the above described manner is to be used for forming the MPP core, the content of carbon (C) should be preferably limited to less than 100 ppm, and the content of the oxygen should be preferably limited to less than 200 ppm. In the case where the contents of carbon and oxygen exceeds the above levels, the powder should be subjected to a reduction treatment under a reducing atmosphere containing hydrogen. The reduction treatment is carried out at a temperature of 700°–800° C. for one hour or more.

Figure 2:
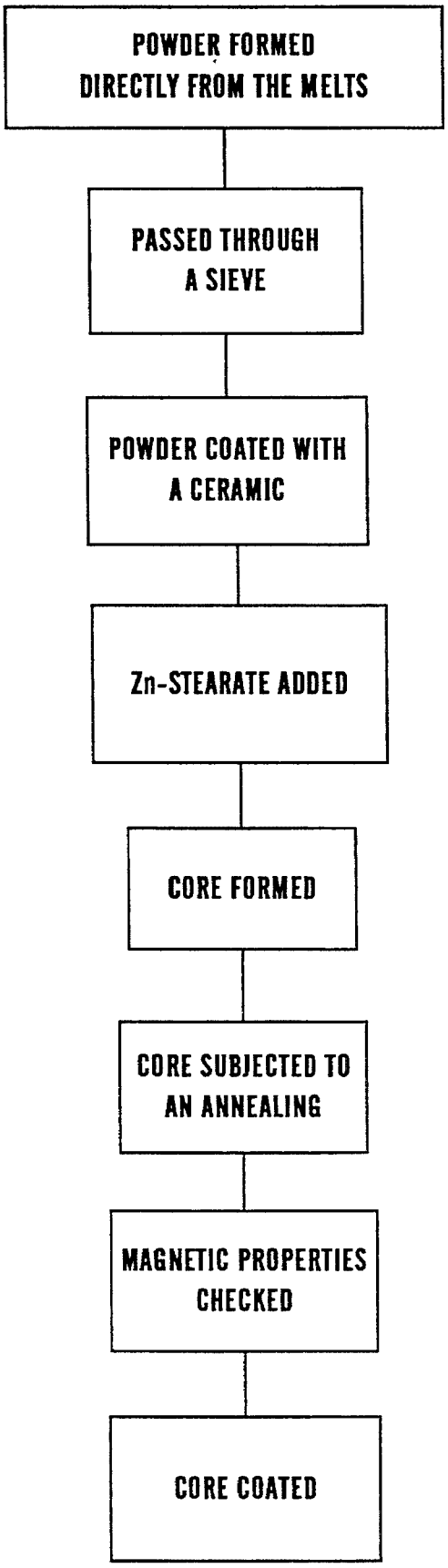
FIG. 2 is a block diagram showing the constitution of the process for manufacturing the MPP core according to the present invention.

Now the process for manufacturing the MPP core will be described based on the process diagram of FIG. 2.

First, an alloy composed of 1.6–4.0% of Mo, 78–83% of Ni, other indispensable impurities and the balance of Fe is melted, and subjected to an alloying treatment. A fluid is spouted into the flow of the melt so as to manufacture a powder. Here, the desirable powder particle size distribution includes 10–15 wt % of −100–+230 meshes, 25–35 wt % of −230–+325 meshes, and 45–65% wt % of −325 meshes. When the core is formed, the distribution of the particle sizes is closely related to the formation density of the core. Therefore, if the particle size distribution ranges depart from the above described ranges, the formation density can be lowered, and therefore, the fluid spouting conditions should be limited, so that the above described particle size distribution can be obtained. In the above particle size distribution, it is desirable that the average particle size is 90 μm for the range of −100–+230, 70 μm for the range of −230–+325 meshes, and 45 μm for the range of −325 meshes. Further, the fluid spouting conditions should be properly decided in such a manner that the particle shape and the atomic arrangement suitable for forming the MPP core can be obtained.

If the contents of carbon and oxygen are over 100 ppm and over 200 ppm respectively, then the powder has to be subjected to reduction treatment under a reducing atmosphere containing hydrogen. This reduction treatment should be preferably carried out at a temperature of 700°–800° C. for more than one hour.

The powder is coated in the usual manner, and the intended core is formed. Preferably, in forming the core, a power press may be used with a forming die and with a forming pressure of 240,000 psi.

Under this condition, in order to reduce the frictions between the compacted body and the forming die and between the powder particles, it is preferable that 1% of Zn-stearate is mixed with the powder.

Then, the formed core is subjected to an annealing treatment, and the magnetic properties are checked. Then, in order to protect the core characteristics from the humidity and the external atmosphere, a polyester or an epoxy resin is coated on the surface of the core, thereby completing the manufacturing of the MPP core.

The above described annealing is carried out to relieve the residue stress and strain, and the annealing conditions should be controlled in this view. Therefore it is preferable that the annealing should be carried out under a hydrogen-contained reducing atmosphere at a temperature of 530°–740° C. for 0.6 hours or more.

The thickness of the epoxy resin coated layer should be preferably 50–200 μm.

Now the present invention will be described based on the actual examples.

<EXAMPLE 1>

Ni having a purity of 99.9% was charged into an induction furnace in an amount of 1.8 kg, and then, it was heated to 1610° C. to melt it. Then the temperature was raised to 1685° C., and then, 1 kg of an alloy composed of Fe40%–Mo60% was added. Then the mixture was maintained at the mentioned temperature for 1 hour and 10 minutes to melt the alloy. Then 0.4 kg of Fe having a purity of 99.9% was added, and was melted. Then the melts were raised to a temperature of 1710° C., and was maintained at this temperature for one hour, thereby completing the preparation of the melts.

The melts which have been prepared in the above described manner were dropped freely, while spouting an $N_2$ gas of −183° C. with a spouting pressure of 90 psi and with a flow rate of 9 $m^3$/min, thereby manufacturing the powder. Then the particle size distribution was checked, and the results are shown in FIG. 3*a*.

Figure 3A:
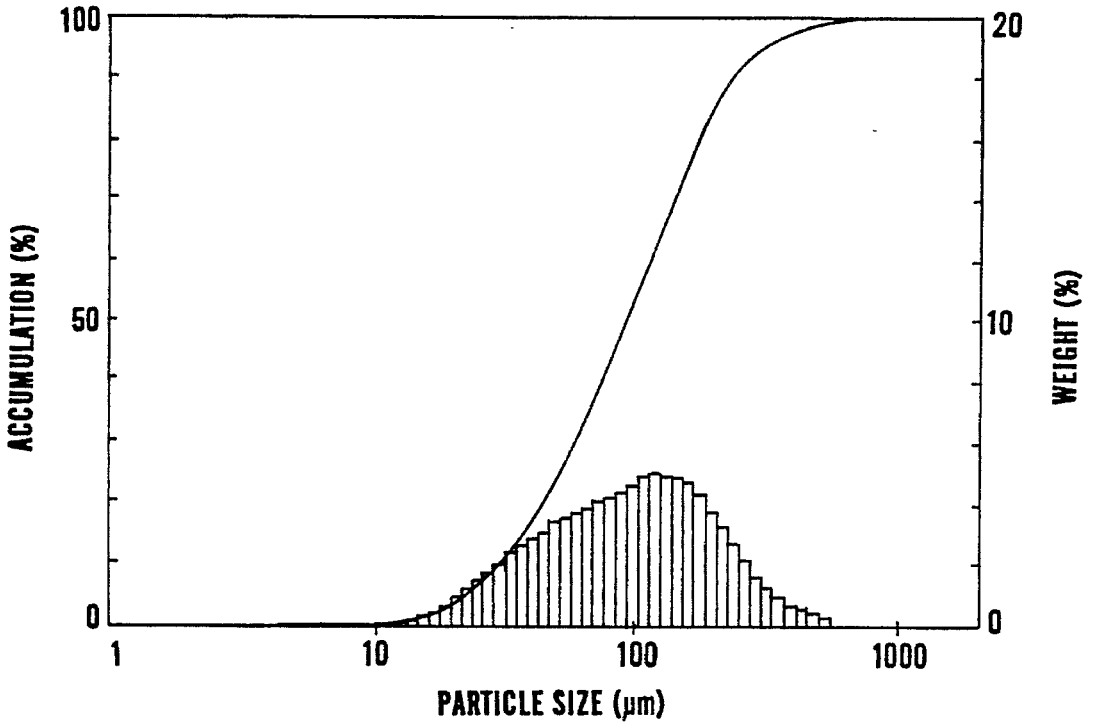
FIGS. 3*a–b* illustrate the distribution of the particle sizes for the powder manufactured by spouting $N_2$ gas into the melts.

As shown in FIG. 3*a*, when the powder was manufactured directly from the melts, the powder having the particle size distribution suitable for the MPP core could be obtained by 65–75%.

<EXAMPLE 2 AND 3>

Figure 3B:
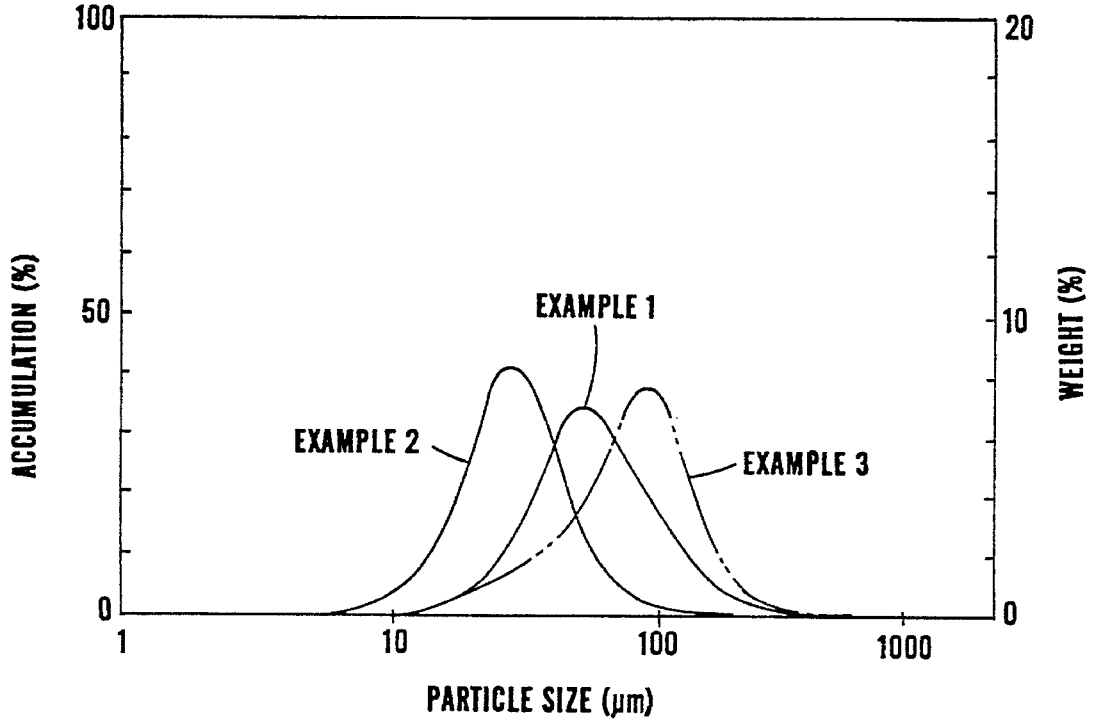

As in the case of Example 1, the fluid consisted of $N_2$ gas, and the powder was manufactured in the same manner as that of Example 1, except that a spouting pressure of 1250 psi and a flow rate of 9 $m^3$/min were used in Example 2, and that a spouting pressure of 45 psi and a flow rate of 9 $m^3$/min were used in Example 3. Then the particle size distribution was checked, and the results are shown in FIG. 3*b*. FIG. 3*b* also shows the powder manufactured under the same conditions as those of Example 1.

As shown in FIG. 3*b*, if the spouting pressure is too high or too low, then the powder suitable for the MPP core can be obtained only by 40–50%.

<EXAMPLE 4>

The powder was manufactured in the same manner as that of Example 1, except that the fluid consisted of water, that the spouting pressure was 1900 psi, and that the flow rate was 150 L/min. Then the particle size distribution was checked, and the results are shown in FIG. 4*a*.

Figure 4A:
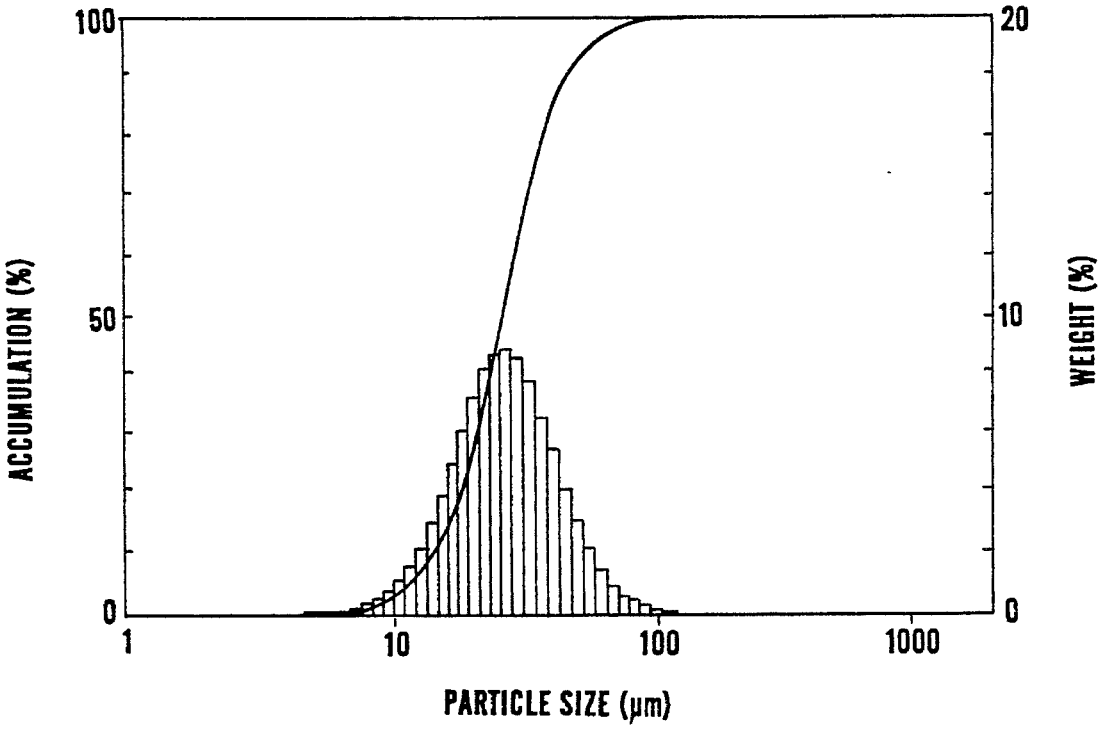
FIGS. 4*a–b* illustrate the distribution of the particle sizes for the powder manufactured by spouting water into the melts.

As shown in FIG. 4*a*, when the powder was manufactured directly from the melts, the powder having the particle size distribution suitable for the MPP core was obtained by 70–80%, thereby showing a desirable result.

<EXAMPLE 5>

The powder was manufactured in the same manner as that of Example 1, except that the spouting pressure of the fluid was 750 psi, and the flow rate was 150 L/min. Then the particle size distribution was checked, and the results are shown in FIG. 4*b*.

Figure 4B:
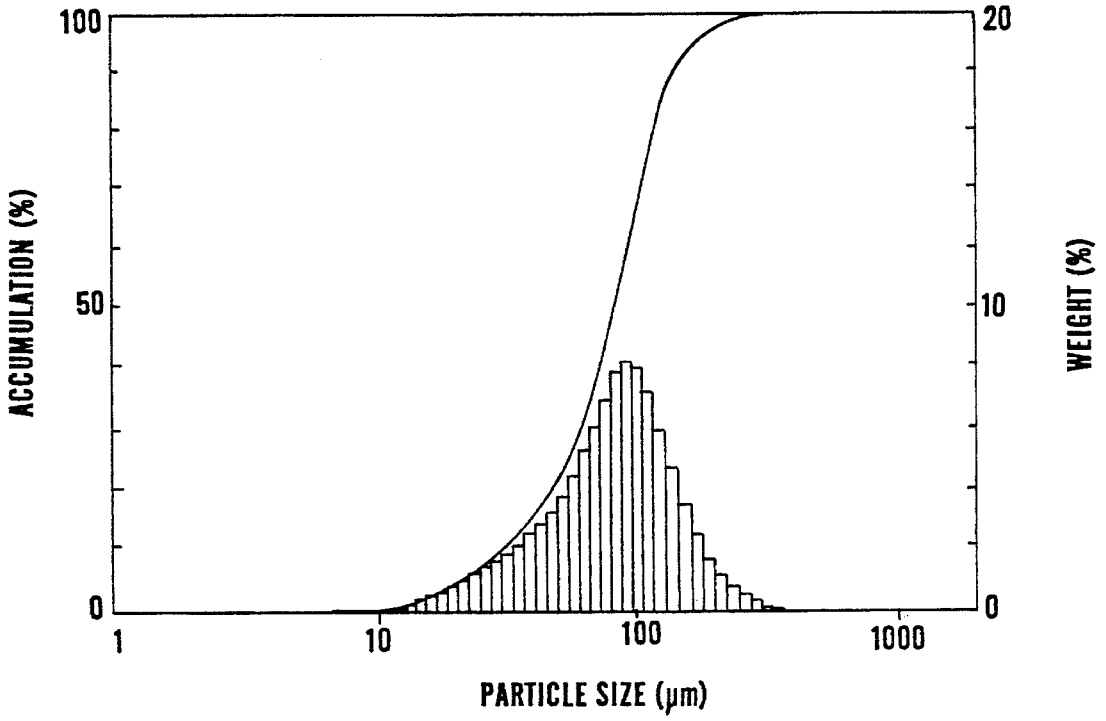

As shown in FIG. 4*b*, if the fluid spouting pressure was too low, then the powder having a particle size distribution suitable for the MPP core could be obtained by only 40–50%.

<EXAMPLE 6>

The powder manufactured based on Example 1 using the same alloy, and the conventional powder manufactured based on the conventional crushing method, were coated with a ceramic under the same conditions. Then cores were formed with a forming pressure of 200,000 psi, and then, the densities of the cores were measured.

According to the measured results, the density of the cores manufactured based on the method of the present invention attained to 91% of the theoretical density, while the density of the cores manufactured based on the conventional method attained to only 87% of the theoretical density.

Therefore, in the case of the present invention, the cores attained to a high density with a low forming pressure of 200,000 psi, and therefore, the life expectancy of the die can be extended, while the damage to the ceramic coating layer can be prevented.

<EXAMPLE 7>

A powder which is manufactured based on Example 1 and which has an average particle diameter of 50 μm was ceramic-coated with a ceramic coating machine. Then Zn-stearate was added by 0.5%, and then, cores were formed with a forming pressure of 240,000 psi and by using a forming die.

Then the cores were subjected to an annealing by maintaining the cores under a hydrogen contained reducing atmosphere at a temperature of 670° C. for 1 hour and 10 minutes. Then the cores were coated with an epoxy resin in a thickness of 100 μm. The variation of the inductance versus the frequency was measured, and the measured results are shown in FIG. 5.

Figure 5:
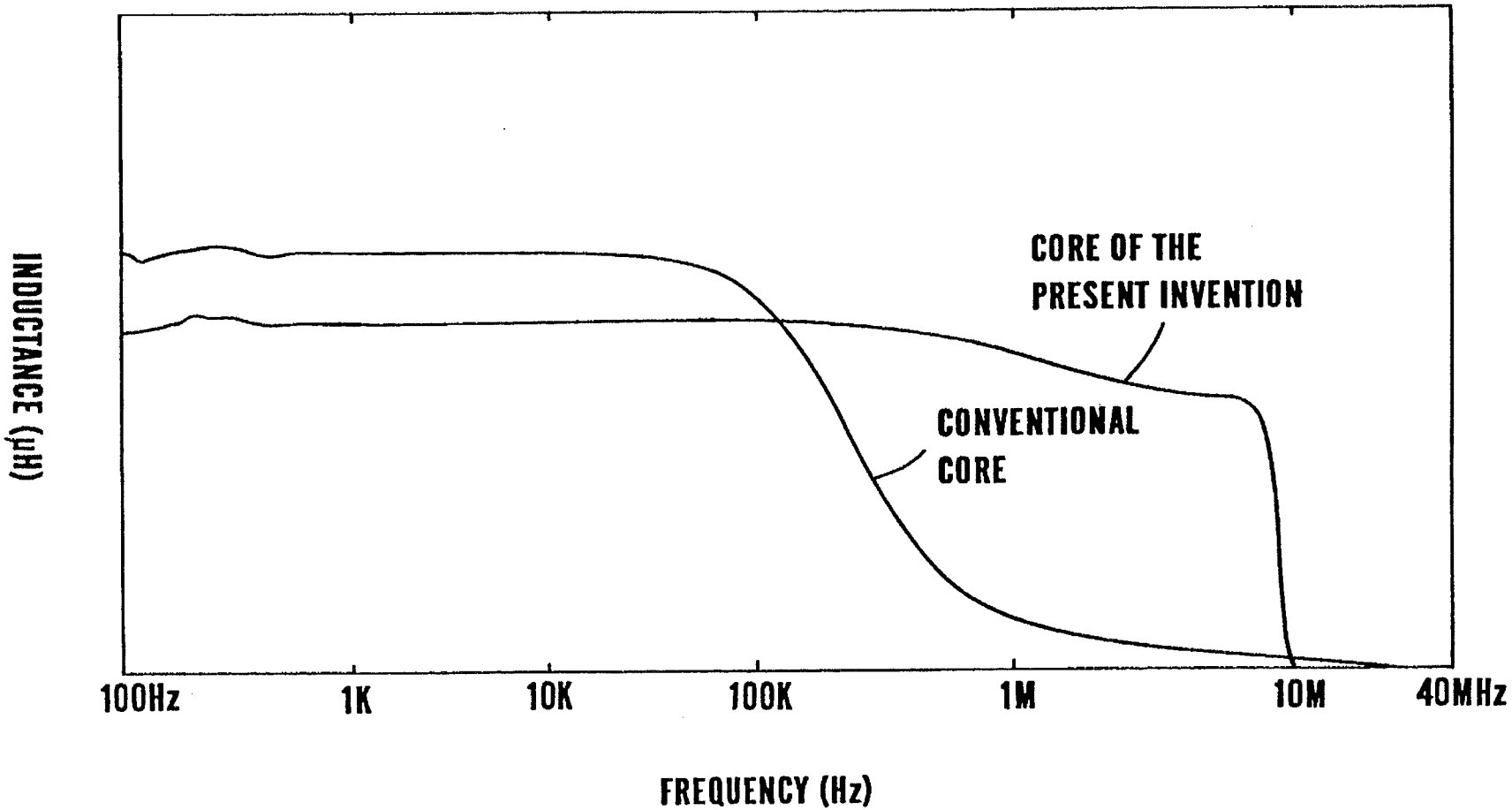
FIG. 5 is a graphical illustration showing the variation of inductance versus the frequency in the MPP core of the present invention and the conventional MPP core.

FIG. 5 illustrates the variations of inductance versus the frequency for the cores which are manufactured based on the conventional crushing method, but composed of the same powder as that manufactured based on the present invention.

As shown in FIG. 5, The MPP core manufactured based on the present invention showed almost the same permeability as that of the MPP core manufactured based on the conventional method. In the frequency characteristics, the MPP core of the present invention was superior over the conventional MPP core.

The reason why the MPP core of the present invention is superior over the conventional one is that the shape of the powder particles is not sharp, and that the ceramic coating of the powder particles is uniform, as well as maintaining the uniform coating layers during the core forming.

According to the present invention as described above, the powder for forming the MPP core can be manufactured directly from the melts by spouting a fluid. Therefore, the manufacturing process is simplified, with the result that the workability and the productivity are improved. Further, powders having diversified particle size distributions, and spherical or polyhedral particle shape can be manufactured by varying the fluid spouting conditions properly. Consequently, the powder yield and the forming density can be not only improved, but also the frequency characteristics for the MPP core can be significantly improved.

What is claimed is:

1. A process for manufacturing a powder for an MPP core (moly permalloy powder core), comprising the steps of:

melting an alloy composed of, in wt %, 1.6–4.0% of Mo, 78–83% of Ni, and the balance of Fe; and manufacturing a powder by spraying a gas selected from the group consisting of $N_2$, He, Ne, An, Kr, Xe and Rn on a flow of the melt with a gas spraying pressure of 50–1200 psi and a gas spraying flow rate of 1–14 $m^3$/min.

2. The process as claimed in claim 1, wherein, at the alloy melting step, Ni is melted, an Fe—Mo alloy and Fe are added, and an alloying treatment is carried out.

3. The process as claimed in claim 2, wherein said Fe—Mo alloy is composed of: 40–70% of Fe, and 30–30% of Mo.

4. The process as claimed in claim 2, wherein the melting temperature of Ni is 1600°–1650° C., the melting temperature of said Fe—Mo alloy and said Fe is 1650°–1700° C., and the alloying treatment is carried out at a temperature range of 1700°–1750° C.

5. The process as claimed in claim 4, wherein the melting time of Ni, the melting time of the Fe—Mo alloy, and the alloying time are respectively one hour or more.

6. The process as claimed in claim 1, wherein the powder has a particle size distribution including 10–15 wt % of −100–+230 meshes, 25–35 wt % of −230–+325 meshes, and 45–65 wt % of −325 meshes.

7. The process as claimed in claim 6, wherein the average particle diameter for the range of −100–+230 meshes is 90 μm, the average particle diameter for the range of −230–+325 meshes is 70 μm, and the average particle diameter for the range of −325 meshes is 45 μm.

8. The process as claimed in claim 1, wherein said manufactured powder is subjected to a reduction treatment under a reducing atmosphere.

9. A process for manufacturing an MPP core, comprising the steps of:

melting an alloy composed of, in wt %, 1.6–4.0% of Mo, 78–83% of Ni, and the balance of Fe;

spraying a gas selected from the group consisting of $N_2$, He, Ne, Ar, Kr, Xe and Rn on a flow of the melt with a gas spraying pressure of 50–1200 psi and a gas spraying flow rate of 1–14 $m^3$/min so as to manufacture a powder;

coating said powder with a ceramic, and forming a core; and subjecting said formed core to an annealing treatment, and then, checking the magnetic properties of said formed core.

10. The process as claimed in claim 9, wherein said powder has a particle size distribution including 10–15 wt % of −100–+230 meshes, 25–35 wt % of −230–+325 meshes, and 45–65 wt % of −325 meshes.

11. The process as claimed in claim 10, wherein the average particle diameter for the range of −100–+230 meshes is 90 μm, the average particle diameter for the range of −230–+325 meshes is 70 μm, and the average particle diameter for the range of −325 meshes is 45 μm.

12. The process as claimed in claim 9, wherein said manufactured powder is subjected to a reduction treatment under a reducing atmosphere prior to said coating step.

13. A process for manufacturing a powder for an MPP core (moly permalloy powder core), comprising the steps of:

melting an alloy composed of, in wt %, 1.6–4.0% of Mo, 78–83% of Ni, and the balance of Fe; and manufacturing a powder by spraying water on a flow of the melt with a water spraying pressure of 800–3000 psi and water spraying flow rate of 110–380 L/min.

14. The process as claimed in claim 13, wherein, at the melting step, Ni is melted, an Fe—Mo alloy and Fe are added, and an alloying treatment is carried out.

15. The process as claimed in claim 14, wherein said Fe—Mo alloy is composed of: 40–70% of Fe, and 30–30% of Mo.

16. The process as claimed in claim 14, wherein the melting temperature of Ni is 1600°–1650° C., the melting temperature of said Fe—Mo alloy and said Fe is 1650°–1700° C., and the alloying treatment is carried out at a temperature range of 1700°–1750° C.

17. The process as claimed in claim 16, wherein the melting time of Ni, the melting time of the Fe—Mo alloy, and the alloying time are respectively at least one hour.

18. The process as claimed in claim 13, wherein the powder has a particle size distribution including 10–15 wt % of −100–+230 meshes 25–35 wt % of −230–+325 meshes and 45–65 wt % of −325 meshes.

19. The process as claimed in claim 18, wherein the average particle diameter for the range of −100–+230 meshes is 90 μm, the average particle diameter for the range of −230–+ 325 meshes is 70 μm, and the average particle diameter for the range of −325 meshes is 45 μm.

20. The process as claimed in claim 13, wherein said manufactured powder is subjected to a reduction treatment under a reducing atmosphere.

21. A process for manufacturing an MPP core, comprising the steps of:

melting an alloy composed of, in wt %, 1.6–4.0% of Mo, 78–83% of Ni, and the balance of Fe;

spraying water on a flow of the melt with a water spraying pressure of 800–3000 psi and a water spraying flow rate of 110–380 L/min so as to manufacture a powder;

coating said powder with a ceramic, and forming a core; and subjecting said formed core to an annealing treatment, and then, checking the magnetic properties of said formed core.

22. The process as claimed in claim 21, wherein said powder has a particle size distribution including 10–15 wt % of −100–+230 meshes, 25–35 wt % of −230–+325 meshes, and 45–65 wt % of −325 meshes.

23. The process as claimed in claim 22, wherein the average particle diameter for the range of −100–+230 meshes is 90 μm, the average particle diameter for the range of −230–+325 meshes is 70 μm, and the average particle diameter for the range of −325 meshes is 45 μm.

24. The process as claimed in claim 21, wherein said manufactured powder is subjected to a reduction treatment under a reducing atmosphere prior to said coating step.

* * * * *